US009266166B2

(12) United States Patent
Yagami et al.

(10) Patent No.: US 9,266,166 B2
(45) Date of Patent: Feb. 23, 2016

(54) BLADE, IMPELLER, TURBO FLUID MACHINE, METHOD AND APPARATUS FOR MANUFACTURING BLADE

(71) Applicant: HITACHI PLANT TECHNOLOGIES, LTD., Tokyo (JP)

(72) Inventors: Tetsuya Yagami, Tokyo (JP); Toshiya Teramae, Tokyo (JP); Koji Hayashi, Tokyo (JP); Kazutoshi Yanagihara, Tokyo (JP); Ryouichi Kataoka, Tokyo (JP)

(73) Assignee: HITACHI, LTD., Tokyo (JP)

( * ) Notice: Subject to any disclaimer, the term of this patent is extended or adjusted under 35 U.S.C. 154(b) by 406 days.

(21) Appl. No.: 13/713,339

(22) Filed: Dec. 13, 2012

(65) Prior Publication Data

US 2013/0104356 A1 May 2, 2013

Related U.S. Application Data

(62) Division of application No. 12/453,692, filed on May 19, 2009, now Pat. No. 8,360,729.

(30) Foreign Application Priority Data

May 19, 2008 (JP) ..... 2008-130558
Jan. 21, 2009 (JP) ..... 2009-011049

(51) Int. Cl.
*B21D 22/02* (2006.01)
*B21K 3/04* (2006.01)
(Continued)

(52) U.S. Cl.
CPC . *B21K 3/04* (2013.01); *B21D 22/02* (2013.01); *B21D 31/005* (2013.01); *B21D 53/78* (2013.01); *F01D 5/14* (2013.01); *Y10T 29/37* (2015.01); *Y10T 29/49337* (2015.01)

(58) Field of Classification Search
CPC ..... B21K 3/04; B21D 22/02; B21D 31/005; B21D 53/78; F01D 5/14; Y10T 29/37; Y10T 29/49337
USPC ..... 72/293
See application file for complete search history.

(56) References Cited

U.S. PATENT DOCUMENTS 3,012,308 A * 12/1961 Zech et al. ..... 29/889.7
3,580,039 A * 5/1971 Heinonen ..... 72/316
(Continued)

FOREIGN PATENT DOCUMENTS

CN 2844526 Y 12/2006
JP 06-109000 4/1994
(Continued)

OTHER PUBLICATIONS

Office Action from Chinese Patent Office for the corresponding Chinese Patent Application No. 200910203096.0 dated Nov. 9, 2010 (5 pages).
(Continued)

*Primary Examiner* — David B Jones
(74) *Attorney, Agent, or Firm* — Nicholas Trenkle; Stites & Harbison PLLC

(57) ABSTRACT

Plural saddle shape patches are formed on a blank material for forming a blade using a manufacturing apparatus provided with a punch support having punches each with a holder attached to be opposite with one another at a predetermined interval corresponding to a thickness of the blank material. The punch support is mounted to a second ram via a second rotational mechanism which is rotatable in a direction in which the ram moves. The die is attached to the first ram via the first rotational mechanism. The actuator controls the rotating angles of both the rotational mechanisms.

1 Claim, 14 Drawing Sheets

(51) Int. Cl.

| | |
|---|---|
| ***B21D 31/00*** | (2006.01) |
| ***B21D 53/78*** | (2006.01) |
| ***F01D 5/14*** | (2006.01) |

(56) References Cited

U.S. PATENT DOCUMENTS

| | | | | | |
|---|---|---|---|---|---|
| 4,164,061 | A | * | 8/1979 | Bronovsky et al. | 29/889.7 |
| 4,367,641 | A | * | 1/1983 | Mizutani | 72/65 |
| 4,656,860 | A | * | 4/1987 | Orthuber et al. | 72/299 |
| 5,046,245 | A | * | 9/1991 | Weetman et al. | 29/889.7 |
| 5,461,893 | A | * | 10/1995 | Tyler | 72/16.2 |
| 5,829,955 | A | | 11/1998 | Saito et al. | |
| 5,884,517 | A | * | 3/1999 | Yogo | 72/166 |
| 6,007,300 | A | | 12/1999 | Saeki et al. | |
| 6,857,303 | B2 | * | 2/2005 | Latour | 72/307 |
| 8,360,729 | B2 | * | 1/2013 | Yagami et al. | 416/185 |
| 2009/0285687 | A1 | * | 11/2009 | Yagami et al. | 416/179 |

FOREIGN PATENT DOCUMENTS

| | | |
|---|---|---|
| JP | 07-167099 | 7/1995 |
| JP | 2000-145607 | 5/2000 |
| JP | 2002-227603 | 8/2002 |
| JP | 2003-254217 | 9/2003 |

OTHER PUBLICATIONS

Office Action, from the Japanese Patent Office, in corresponding Japanese Patent Application No. 2009-011049 dated Aug. 21, 2012, pp. 1-4.

* cited by examiner

BLADE, IMPELLER, TURBO FLUID MACHINE, METHOD AND APPARATUS FOR MANUFACTURING BLADE

CLAIM OF PRIORITY

This application is a Divisional of U.S. application Ser. No. 12/453,692 filed on May 19, 2009. Priority is claimed based on U.S. application Ser. No. 12/453,692 filed on May 19, 2009, which claims priority from Japanese patent applications JP 2008-130558 filed on May 19, 2008, and JP 2009-011049 filed on Jan. 21, 2009, the content of which is hereby incorporated by reference into this application.

BACKGROUND OF THE INVENTION

1. Field of the Invention

The present invention relates to an impeller of a turbo fluid machine using liquid such as water as a working fluid, a blade used for the impeller, a method and an apparatus for manufacturing the impeller. More particularly, the present invention relates to a less expensive method for manufacturing the impeller of the turbo fluid machine realized by plate working of the impeller irrespective of the form and the fluid type.

2. Description of the Related Art

The turbo fluid machine includes a centrifugal compressor using gas such as air as the working fluid in addition to the centrifugal pump using liquid such as water as the working fluid. An exemplary turbo fluid machine of those described above is disclosed in JP-A No. 7-167099.

The centrifugal pump using water as the working fluid, for example, will be described with respect to the main components by referring to FIG. 1. The centrifugal pump includes impellers 6, 7, a casing 1, an axis of rotation 2, and a motor (not shown). Each of the impellers 6 and 7 has a structure with plural blades 5 interposed between a boss 3 and a shroud 4. They are rotated by the axis of rotation 2 to apply energy to the fluid. That is, rotation of the impeller applies the centrifugal force to water accommodated from an inlet 8. The flow direction of the fluid is optimized by a guide vane attached to an outlet port of the impeller.

An axial-flow pump of the centrifugal pump has a feature that the blade of the impeller has a torsion with respect to the flow path direction in order to efficiently convert the pump rotational energy into the kinematic energy of the fluid.

Basically, the centrifugal compressor has substantially the same structure as that of the centrifugal pump. For example, in a multistage turbocompressor, the impellers 6 and 7 each having plural blades 5*a* and 5*b* attached to the respective bosses 3 are mounted on the same axis 2 as shown in FIG. 2. In the multistage turbocompressor, each blade of the respective impellers has the different shape. The blade used for the compressor has the blade surface designed in accordance with the linear element as substantially the straight line.

In the method for manufacturing the turbo fluid machine, the impeller is produced by casting, and then machining. If the high profile accuracy of the blade is required, the impeller as a whole may be subjected to the machining so as to be manufactured. If the blade of the impeller has the three-dimensional torsion, the press forming using the three-dimensional forming die exclusively tailored to the respective blades may be employed.

The casing is produced through the plate working method in which the blade formed of the press formed steel plate is welded to inner and outer cylinders each formed by subjecting the steel plate to the roll forming.

The blade of the compressor as one of the existing turbo fluid machines is subjected to the machining after the casting. However, in the aforementioned process, the large diameter parts may lower the material yield. The action for solving the aforementioned problem is required to be taken. The press forming using the three-dimensional forming die especially tailored to the respective blades has a large ratio of the die cost to the manufacturing cost upon plate working of the impeller. The similar problem may occur in manufacturing of the blade and casing of an mixed flow pump.

In the method for manufacturing the casing, the use of the sheet processing machine instead of the three-dimensional forming die for producing the guide vane may suppress the cost for the die. However, it is impossible for the generally employed sheet metal processing machine to subject the blade to the three-dimensional torsion in principle. Accordingly, the method is not suitable for manufacturing the impeller. It has been demanded to realize the plate working of the impeller at the low cost has been demanded as the essential task of the present invention.

There are problems with respect to subject the blade to the three-dimensional forming. That is, when the blade with the three-dimensional torsion is press formed with the upper and the lower dies, as the blank material is not restrained between the dies at the initial stage of the forming where the blank material and the die partially contact with each other, the blank material, thus is likely to misalign. In the generally employed method for manufacturing the blade, the blank material which contains the margin to be larger than the finished blade in consideration of the displacement is press formed. Then the closest region to the blade surface with the finished shape is cut from the formed material. However, the blank material for forming the blade to be used under the specific environment, for example, the seawater pump is expensive. It is therefore demanded to suppress the material yield. Suppression of the material misalignment upon press forming, thus, is the essential task to be realized by the present invention. Vibration of the impeller caused by oscillation in the profile accuracy of each of the blades may cause noise in operation of the turbo fluid machine. It is therefore essential to establish the assembly accuracy of the impeller.

SUMMARY OF THE INVENTION

It is an object of the present invention to provide a method and an apparatus for manufacturing an impeller, and a blade and an impeller which allow application of the method and the apparatus in consideration with the cost reduction of the turbo fluid machine. It is another object of the present invention to provide a blade which allows the impeller to be formed with high accuracy.

According to the invention, a blade is joined between a boss and a shroud or joined with the boss of an impeller which is rotatably mounted on a turbo fluid machine. A surface of the blade is formed of a plurality of saddle shape patches each formed through an incremental forming. A bending angle of the surface of the blade has both positive and negative values.

This makes it possible to provide the turbo fluid machine which includes the blade with the three-dimensional torsion required to have the fluid performance. The less expensive turbo fluid machine may be provided without using the three-dimensional forming die while maintaining the same performance as the related art.

In the aforementioned structure, the surface of the blade is formed of the plurality of saddle shape patches each separated by substantially a straight boundary.

The present invention provides the turbo fluid machine which includes the blade with the three-dimensional torsion required to have the fluid performance. The less expensive turbo fluid machine may be provided without using the three-dimensional forming die while maintaining the same performance as the related art. Because of substantially straight boundary between the saddle shape patches, the blade defined by the straight linear element used especially for the turbocompressor does not have to be re-designed, thus reducing the production lead time including the design process.

In the aforementioned structure, the surface of the blade is formed of the plurality of saddle shape patches each separated by a curved boundary.

The present invention provides the turbo fluid machine which includes the blade with the three-dimensional torsion required to have the fluid performance. The less expensive turbo fluid machine may be provided without using the three-dimensional forming die while maintaining the same performance as the related art. Because of the curved boundary between the saddle shape patches, the degree of freedom in designing the blade shape is improved, leading to the improved performance of the turbo fluid machine.

In the aforementioned structure, the surface of the blade is formed of at least two saddle shape patches, and the saddle shape patches are disposed not to be adjacent with each other. A patch with substantially a flat surface or a conical surface having the boundary as a generatrix is disposed between the saddle shape patches.

The present invention provides the turbo fluid machine which includes the blade with the three-dimensional torsion required to have the fluid performance. The saddle shape patch is disposed to the portion which influences the performance, and the patch with a flat surface or the cone surface is employed to the portion having no correlation between the performance and the shape for facilitating the forming, thus reducing the production costs while improving the performance of the turbo fluid machine.

In the aforementioned structure, the saddle shape patch includes at least one concave area or one convex area, and the concave area or the convex area is formed on the surface of the blade in an in-plane direction.

In the aforementioned structure, the blade of the impeller is formed into the saddle shape using the press die by joining the concave area or the convex area of the blade with the corresponding convex area or the concave area formed in the die for press forming so as to suppress misalignment of the blank material. The blade surface may be formed into the desired three-dimensional torsion shape with high accuracy. The performance of the turbo fluid machine, thus may be improved. As no misalignment in the blank material occurs during the press forming of the blade, the expanded blank shape of the blade with the finished shape may be used as the blank material. This may eliminate the generally employed cutting process and improve the material yield.

The impeller is formed by joining a blade between a boss and a shroud, or joining a blade with the boss of the impeller to be rotatably mounted on a turbo fluid machine. The blade as described above is employed.

The present invention provides the turbo fluid machine which includes the impeller with three-dimensional torsion which is required to have the pump performance while maintaining the same performance as the related art. As the three-dimensional forming die does not have to be used, the resultant turbo fluid machine may be less expensive.

In the structure, the blade includes a concave area or a convex area, and the boss includes a convex area or a concave area formed on a mount position of the blade, which joins with the concave area or the convex area of the blade.

The present invention allows the plural blades to be attached to the impeller with the highly accurate positioning in the process of producing the impeller in addition to the effect derived from the impeller as described above. In the impeller production process, the positioning with respect to the hub is easily performed, thus allowing assembly of the impeller very quickly. As the blades are attached to the impeller with high accuracy, the oscillation owing to variation in the blades and the resultant noise may be reduced.

The turbo fluid machine according to the present invention is provided with any type of the impeller with the structure as described above.

The present invention provides the less expensive turbo fluid machine which exhibits the performance tailored to the required specification.

In a method for manufacturing a blade which forms a plurality of saddle shape patches by subjecting a metal blank material to an incremental forming for producing an impeller rotatably mounted on a turbo fluid machine, each boundary between the saddle shape patches is defined as a straight linear element on an upper surface of the blank material for the blade. A punch support provided with at least one pair of punches having a straight holder and punches disposed opposite with each other, and a die which partially clamps the blank material for the blade to be restrained are used to keep the blank material restrained by bringing a second linear element to be in parallel to an edge of a die shoulder of the die while bringing a first linear element to be in parallel to an edge of the punch. A predetermined stroke is applied in a direction vertical to the blank material while tilting the pair of the punches by a predetermined amount in the plane which includes the first linear element, and is vertical to the blank material to form a saddle shape between the first and the second linear elements. The saddle shapes are sequentially formed between adjacent linear elements as a whole or partially to form the blank material into a desired blade shape.

The present invention allows the blade to be formed into various shapes by simply combining the punch and die, thus providing the less expensive turbo fluid machine.

In a method for manufacturing a blade which forms a plurality of saddle shape patches by subjecting a metal blank material to an incremental forming for producing an impeller rotatably mounted on a turbo fluid machine, each boundary between the saddle shape patches is defined as a straight linear element on an upper surface of the blank material for the blade. First, second and third roller supports each having two upper and lower rollers are used to have each axis of the roller supports brought to be in parallel to first, second, and third linear elements, respectively. When the rollers of one of the roller supports are driven to convey the blank material, a relative positional relationship of the roller supports is adjusted such that a positional relationship between a line passing through a first roller and the linear element before passing through the first roller becomes the positional relationship of the linear elements in accordance with a design shape while being constantly kept in parallel to the linear element passing through the roller to form saddle shapes sequentially for forming the blank material into a desired blank shape.

The present invention allows formation of a large amount of the blades at low costs. This makes it possible to provide the less expensive turbo fluid machine.

In a method for manufacturing a blade which forms a plurality of saddle shape patches by subjecting a metal blank material to an incremental forming for producing an impeller rotatably mounted on a turbo fluid machine, each boundary between the saddle shape patches is defined as a curved line on an upper surface of the blank material for the blade. A multipoint press machine having matrices of plural punches arranged in a width direction of the blank material for the blade oppositely at upper and lower portions is used while keeping plural spherical punches movable in a height direction. The blank material is held in contact with opposite head portions of the punch matrices at the upper and the lower sides in a first process step. A height of the punch matrices is changed to form the saddle shape patch having a curved boundary partially on the blank material in a second process step. An interval between the opposite head portions of the punch matrices is increased to release the blank material in a third process step to form the saddle shape patches sequentially over a whole area of the blank material by performing the first to the third process steps repeatedly to form the blank material into a desired blade shape.

The present invention allows the blade to be formed into various shapes by simply combining the punch and die, thus providing the less expensive turbo fluid machine.

In the aforementioned method, a three-dimensional forming die is used to partially press form a surface of the blade for forming the blade.

The present invention enhances the surface accuracy of the blade, and allows the use of the small three-dimensional forming die. It is, therefore, highly effective for reducing the die cost.

In the aforementioned method, the die includes a concave area or a convex area, and the press forming is performed in a state where a concave area or a convex area preliminarily formed in the blank material for the blade is joined with the concave area or the convex area of the die.

According to the present invention, when forming the blade of the impeller into the saddle shape using the press die, the convex area or the concave area of the blade is joined with the corresponding concave area or the convex area formed in the die so as to be subjected to the press forming, thus suppressing misalignment of the blank material. This makes it possible to form the blade surface into the desired three-dimensional torsional shape with high accuracy, leading to the improved performance of the turbo fluid machine. No misalignment of the blank material in the press forming of the blade allows the expanded blank shape of the blade with the final shape to be used as the blank material. Accordingly, the generally employed cutting process is no longer required, thus improving the material yield.

An apparatus for manufacturing a blade of an impeller rotatably mounted on a turbo fluid machine by performing a plastic deformation of a metal plate blank material is provided with at least a first ram and a second ram each capable of independently displacing and pressurizing, a die for restraining the blank material under pressure applied by the first ram, a punch which deforms the blank material by a displacement of the second ram while having a portion of the blank material protruding from the die kept clamped, a punch support which tilts the punch attached to the second ram via a first rotational mechanism in a vertical direction, a second rotational mechanism which tilts the die and the punch relatively in a horizontal direction, and an actuator for controlling angles of rotation of the first and the second rotational mechanisms. In the apparatus, axes of rotation of the first and the second rotational mechanisms are disposed to be perpendicular to each other to apply a predetermined deformation to the blank material in accordance with the displacement and the tilt of the die and the punch under controls of the first and the second rams, and the actuator.

The present invention allows the blade of the impeller for the turbo fluid machine, which has the three-dimensional torsion required to have the pump performance to be press formed, requiring no use of the exclusive die. The present invention provides the less expensive turbo fluid machine while maintaining the same performance as the related art.

An apparatus for manufacturing a blade of an impeller rotatably mounted on a turbo fluid machine by performing a plastic deformation of a metal plate blank material is provided with first, second and third roller supports each for supporting a pair of rollers which rotate while clamping a blank material, a material handle portion for conveying the blank material by driving the rollers of the first roller support, a frame having the roller supports and the material handle portion mounted. In the apparatus, at least one of the roller supports is mounted on the frame via a slider mechanism which displaces with respect to the other roller supports to deform a plate surface of the blank material. The slider mechanism is formed of a vertical axis of rotation and a horizontal axis of rotation.

The present invention allows the blade of the impeller for the turbo fluid machine, which has the three-dimensional torsion required to have the pump performance to be roll formed. This makes it possible to produce the blade at relatively high speeds. The present invention provides the less expensive turbo fluid machine while maintaining the same performance as the related art.

An apparatus for manufacturing a blade of an impeller rotatably mounted on a turbo fluid machine by performing a plastic deformation of a metal plate blank material is provided with a press mechanism which includes at least one ram capable of displacing and pressurizing, a punch matrix having plural spherical punches supported to be movable in a vertical direction, and a die for restraining a portion of the blank material under a pressure control. In the apparatus, the punch matrix includes a lower punch matrix having the plural punches arranged in a width direction of the blank material, an upper punch matrix having substantially the same number of punches as that of the lower punch matrix. A pressure force of the ram is used to pressurize both surfaces of the blank material to be plastically deformed.

In the present invention, the blade of the impeller for the turbo fluid machine may be formed to have the three-dimensional torsion required to have the pump performance without using the exclusive die. The present invention provides the less expensive turbo fluid machine while maintaining the same performance as the related art.

The forming method allows the blade surface with plural saddle shape patches to be subjected to combination of the torsion and the bending. This makes it possible to perform the plate working of the impeller which includes the blade with the three-dimensional torsion. The pair of the punch and die allows formation of various types of blades instead of using the forming die, which is expected to reduce the die cost. As the period for producing the die can be reduced, the production lead time may be shortened, and the plate working method is applicable to the small-lot production.

The plate working of the impeller makes it possible to make the blade thinner than the general cast product, and further to reduce the weight of the impeller, resulting in the energy conservation in the operation of the turbo fluid machine. In the case of producing the blade through the general casting, the metal is required to be heated to the melting point or higher. Meanwhile in the present invention, the blade may be produced using the press machine adapted for the size of the blank material for forming the blade. This makes it possible to conserve the energy in manufacturing process steps.

With the method for manufacturing the blade of the impeller for the turbo fluid machine, the joint type guide according to the present invention is employed upon incremental press forming of the leading end of the blade using the three-dimensional die. The positional relationship between the press die and the blank material may be stabilized, thus allowing the press forming with high reproducibility. It is possible to form the blade with high accuracy.

DESCRIPTION OF THE PREFERRED EMBODIMENTS

Embodiments of the present invention will be described in detail. The manufacturing method according to the present invention is applied to the apparatus having the blade surface of the impeller formed of the straight linear elements, and the linear punches opposite with each other to achieve the aforementioned objects.

First Embodiment

Figure 1:
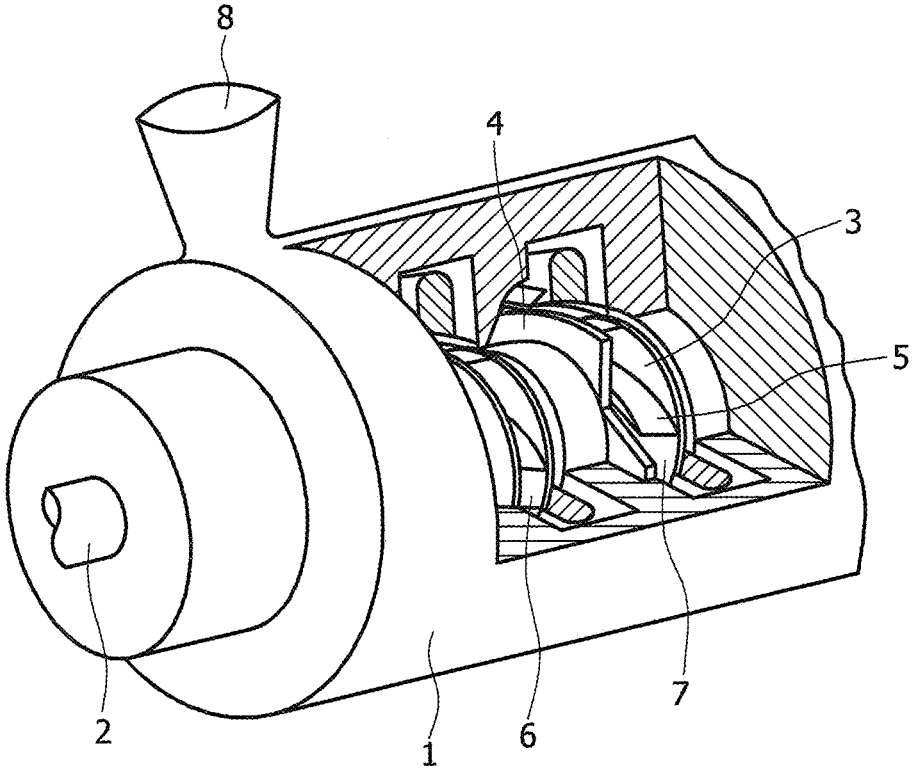
FIG. 1 is a cross-sectional perspective figure of a turbocompressor to which the present invention is applied.
Figure 2:
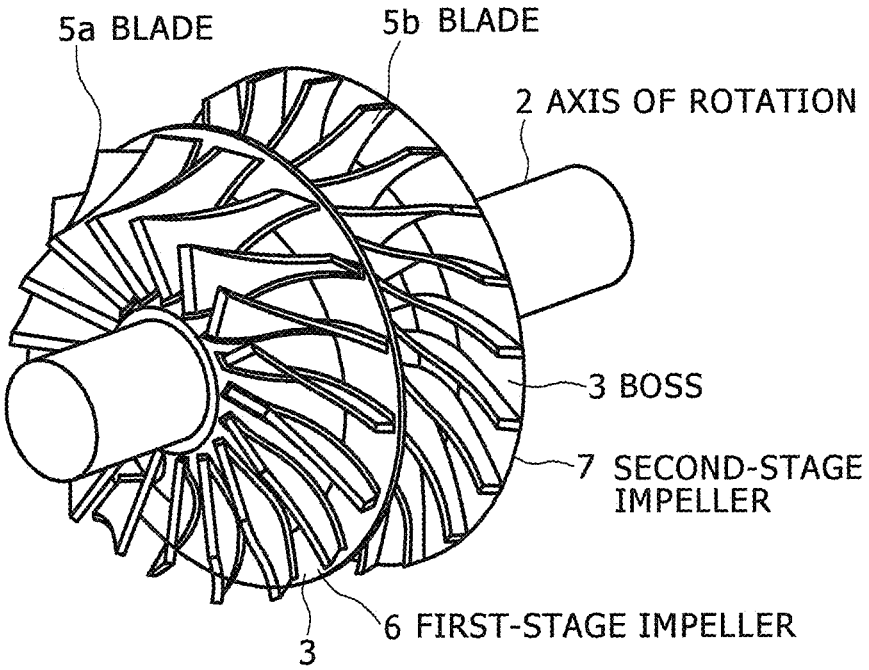
FIG. 2 is a perspective figure of an impeller shown in the same way as FIG. 1.

FIG. 1 is a cross-sectional perspective figure of a portion of the turbo fluid machine to which the first embodiment of the present invention is applied, which shows the structure of a centrifugal compressor using air as the working fluid. FIG. 2 is a perspective figure of the impeller while having the shroud omitted.

Referring to FIG. 1, a multistage centrifugal compressor includes impellers 6, 7, a casing 1, an axis of rotation 2 and a motor (not shown). Each of the impellers 6 and 7 has the structure having plural blades 5 interposed between a boss 3 and a shroud 4. They are rotated around the axis of rotation 2 to apply energy to the fluid. In other words, the rotation of the impeller applies the centrifugal force to water fed through an inlet 8. A guide vane attached to an outlet of the impeller serves to optimize the fluid flow direction. The impellers 6 and 7 form the multistage structure mounted on the axis of rotation 2 as shown in FIG. 2, each of which has the different blade shape at the stage and different three-dimensional torsion.

Figure 3:
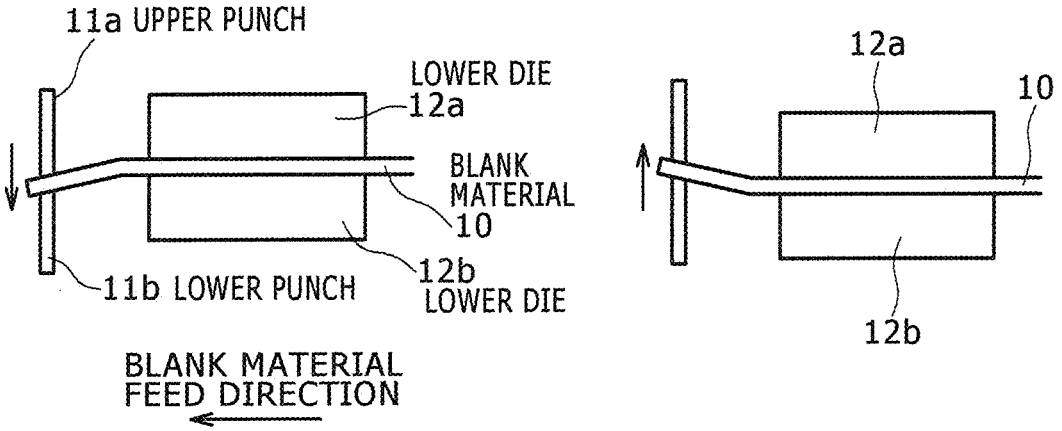
FIG. 3 schematically shows a bending deformation as a first basic element of a blade structure according to the present invention.

FIG. 3 schematically shows a bending deformation as a first basic element of the method for manufacturing the blade of the embodiment. In the state where a plate-like metal blank material 10 is restrained between upper and lower dies 12*a* and 12*b* with a blank holder, a pair of upper and lower punches 11*a* and 11*b* in contact with the blank material 10 are stroked upward to cause the blank material 10 which protrudes from the upper and the lower dies 12*a* and 12*b* to be bent upward. Likewise, the upper and the lower punches 11*a* and 11*b* are stroked downward to cause the blank material 10 which protrudes from the upper and the lower dies 12*a* and 12*b* to be bend downward. Assuming that the angle defined by the upward bend is referred to as the positive bending angle, the angle defined by the downward bend is referred to as the negative bending angle.

Figure 4:
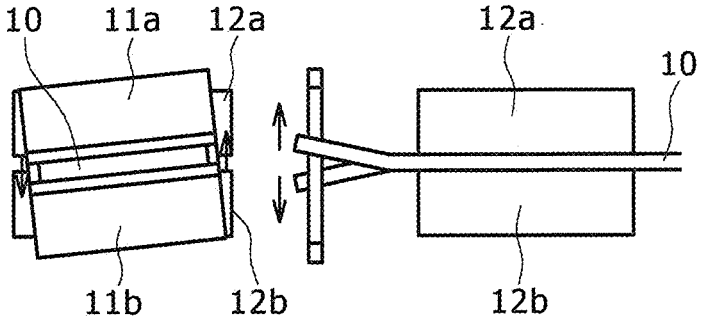
FIG. 4 schematically shows a torsional deformation as a second basic element of the blade structure according to the present invention.

FIG. 4 represents a torsional deformation as a second basic element of the method for manufacturing the blade of the embodiment. In the state where the blank material 10 is restrained between the dies 12*a* and 12*b* with the blank holder, the pair of the upper and the lower punches 11*a* and 11*b* in contact with the blank material 10 is rotated around the axis perpendicular to the side surface of the punch to cause the blank material 10 which protrudes from the upper and the lower dies 12*a* and 12*b* to be torsionally deformed.

Figure 5:
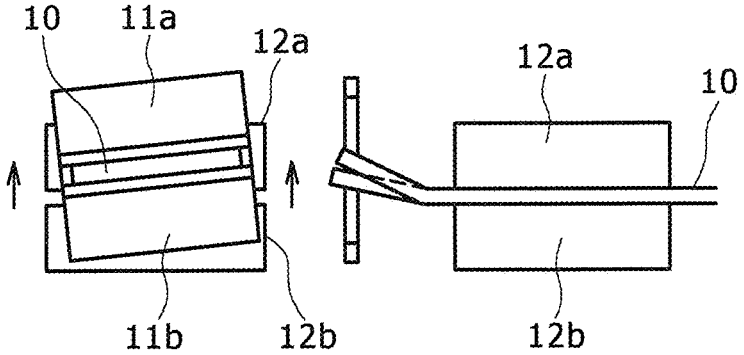
FIG. 5 schematically shows the deformation as a combination of the basic elements shown in FIGS. 3 and 4.

FIG. 5 schematically shows the three-dimensional torsion applied to the blank material 10 by combining deformations of the first and the second basic elements. That is, the upper and the lower punches 11*a* and 11*b* are rotated around the axis perpendicular to the side surface of the punch while moving those upper and the lower punches 11*a* and 11*b* in contact with the blank material 10 in the vertical direction. As a result, the element which protrudes from the upper and the lower dies 12*a* and 12*b* is subjected to both the torsional and bending deformations, simultaneously.

Figure 6:
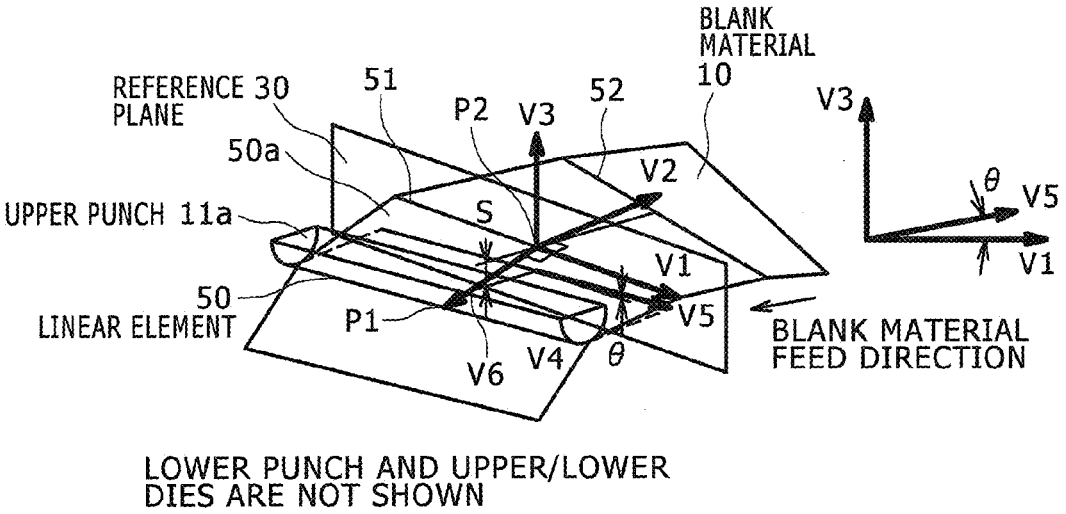
FIG. 6 is a figure representing the mechanism for obtaining the angle of torsion and a bending stroke from CAD data.

FIG. 6 shows the mechanism for obtaining the angle θ of torsion and the bending stroke S from the CAD data. The blade surface 10 (blank material) with the design shape is schematically shown to explain the method for determining the angle θ of torsion and the bending stroke S required for forming a saddle shape patch 50*a* between linear elements 50 and 51 as a boundary. Referring to the figure, the thickness of the blank material is not shown. However, the angle of torsion and the stroke may be derived from the design data with respect to the pressure surface.

The equation for obtaining the angle of torsion is represented by the following formula 1. The code "·" (dot) denotes the inner product of vector.

$$\tan\theta=(V3\cdot V5)/(V1\cdot V5) \qquad \text{Formula 1}$$

θ: angle defined by vectors V5 and V1 measured on a reference plane 30;

V1: Unit vector which represents the linear element 51;

V3: Unit vector perpendicular to line segment P2P3 and V1; and

V5: Vector projected by the normal on the reference plane 30.

The equation for obtaining the stroke is represented by the following formula 2.

$$S=V3/|V3|\cdot V6 \qquad \text{Formula 2}$$

V6: vector parallel to the line segment P1P2

The specific values of the angle of torsion and the stroke amount derived from the blade shape used for the verification will be shown in Table 1 as the calculation example.

TABLE 1

| Angle of torsion | Stroke (mm) |
|---|---|
| 0.272 | −3.160 |
| 1.786 | 0.000 |
| 2.015 | −1.810 |
| 2.611 | −2.990 |
| 4.861 | 0.840 |
| 4.650 | 0.710 |

It is preferable to use one-step finite element method for defining the straight linear elements 50, 51, 51 . . . on the surface of the blank material 10. The model with the designed shape is forcedly expanded on the plane to copy the linear element with the blade surface shape on the blank material surface at the initial stage. Although the linear element of the design shape is curved on the blank material surface at the initial stage in comparison with the linear element as the design shape in the general case, the linear element copied to the initial blank material surface may be approximated to the straight line so long as the degree of deformation is at the level of the blade surface.

Figure 7A:
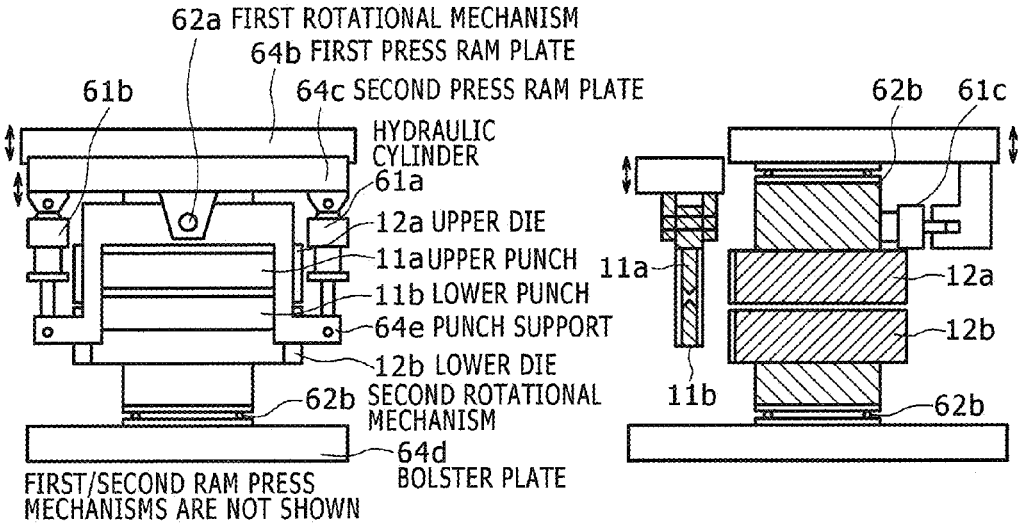
FIG. 7A and FIG. 7B schematically show the system structure of a forming device according to a first embodiment of the present invention.

FIG. 7A schematically shows the structure of the forming device. More specifically, the illustration provided on the right in FIG. 7A is a partial cross-sectional view of the illustration of the exemplary forming device provided on the left in FIG. 7A that would be exposed by making a straight cut through the illustration of the forming device on the left in a plane that is formed by extending a vertical line on the front face of the illustration into the page of the drawing sheet, removing the right-side portion of the cut to the illustration provided on the left in FIG. 7A, and rotating the remaining left-portion portion 90 degrees about the vertical axis to expose the face on the cut on the left-portion portion in the plane of the page. Reference numerals 64*b* and 64*c* denote a first press ram plate (first ram) and a second press ram plate (second ram) each having a double-acting press unit (not shown) which is allowed to displace/pressurize independently. The first ram 64*b* is provided with upper and lower dies 12*a* and 12*b* via a second rotational mechanism 62*b*. After setting the plate-like blank material 10 between the upper and the lower dies 12*a* and 12*b*, the pressure is applied to the first ram 64*b* to restrain the blank material 10. A hydraulic cylinder 61*c* as an actuator is controlled to adjust each angle of the upper and the lower dies 12*a* and 12*b* by rotating (inclining) the second rotational mechanism 62*b* on the horizontal plane. The partial cross-sectional illustration of the exemplary forming device provided on the right in FIG. 7A shows the operational relationship between the hydraulic cylinder 61and the second rotational mechanism 62*b* that allows for the hydraulic cylinder 61*c* to control the angle of rotation of the second rotational mechanism 62*b* in the horizontal plane in the exemplary forming device of FIG. 7A.

The second ram 64*c* is provided with a punch support 64*e* via the first rotational mechanism 62*a* which is rotatable (tiltable) in a vertical plane in the ram movement direction. The punch support 64*e* is rotated around the first rotational mechanism 62*a* by the hydraulic cylinders 61*a* and 61*b* each as the actuator so as to be tilted. The punch support 64*e* is provided with punches 11*a* and 11*b* at the upper and the lower portions, having the linear holding portions for depressing the blank material facing with each other at a predetermined interval equivalent to the thickness of the blank material 10. The partial cross-sectional illustration of the exemplary forming device provided on the right in FIG. 7A is shows the positional relationships of the upper and lower punches 11*a* and 11*b* and the upper and lower dies 12*a* and 12*b* of the exemplary forming device in correspondence with the exemplary elements of deformation of a blade structure that are illustrated in FIGS. 3-5. The punches 11*a* and 11*b* may be attached while having the interval therebetween adjustable. This makes it possible to cope with blank materials with different thickness values. Each axis of rotation of the first rotational mechanism 62*a* and the second rotational mechanism 62*b* is substantially perpendicular to an edge of a die shoulder portion of the die. The interval between the edge of the die shoulder and the punch is set to be substantially equivalent to the thickness of the blank material.

The blank material 10 is clamped between the upper and the lower punches 11*a* and 11*b*. The second ram 64*c* is tilted in the vertical direction through rotation of the first rotational mechanism 62*a* and the dies 12*a* and 12*b* are tilted in the horizontal direction through rotation of the second rotational mechanism 62*b* to perform bending and torsional operations. As the blank material is subjected to the bending and the torsional operations in accordance with the relative positional relationship between the dies 12*a*, 12*b* and the punches 11*a* and 11*b*, the horizontal rotating (tilting) function may be added to the first rotational mechanism 62*a* instead of the rotating (tilting) function on the horizontal planes of the dies 12*a* and 12*b*.

Figure 7B:
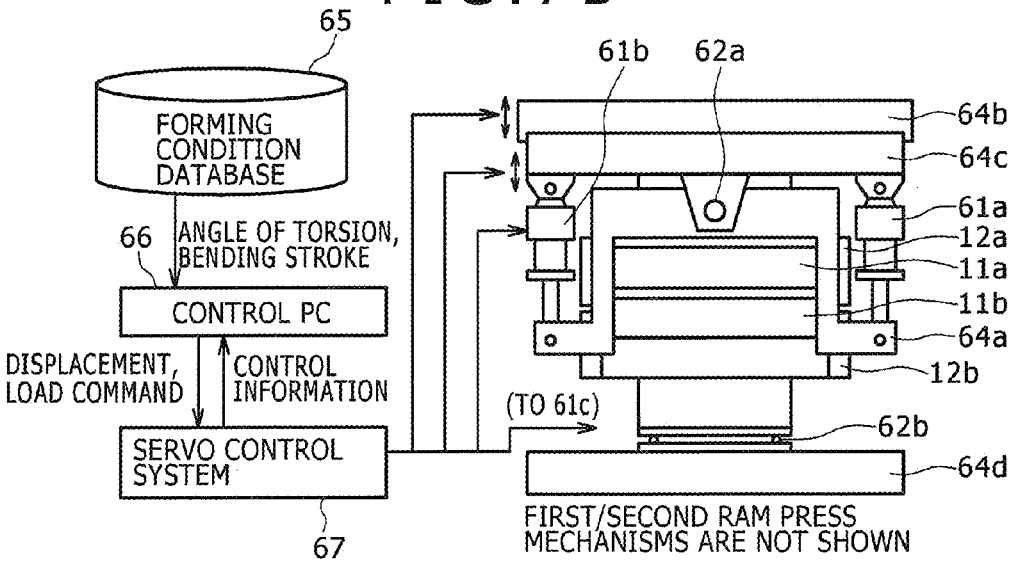

FIG. 7B schematically shows the structure of the forming device including the control system. Values of the bending stroke and the angle of torsion of the respective linear elements 50, 51 and 52 (refer to FIG. 9 to be described later) are read to a control PC for control as needed from a forming condition database 65 which stores the forming condition as electronic data. A servo control system 67 controls the hydraulic cylinders 61*a*, 61*b*, 61*c*, 61*d*, the first ram 64*b* and the second ram 64*c* in accordance with the command.

Figure 8:
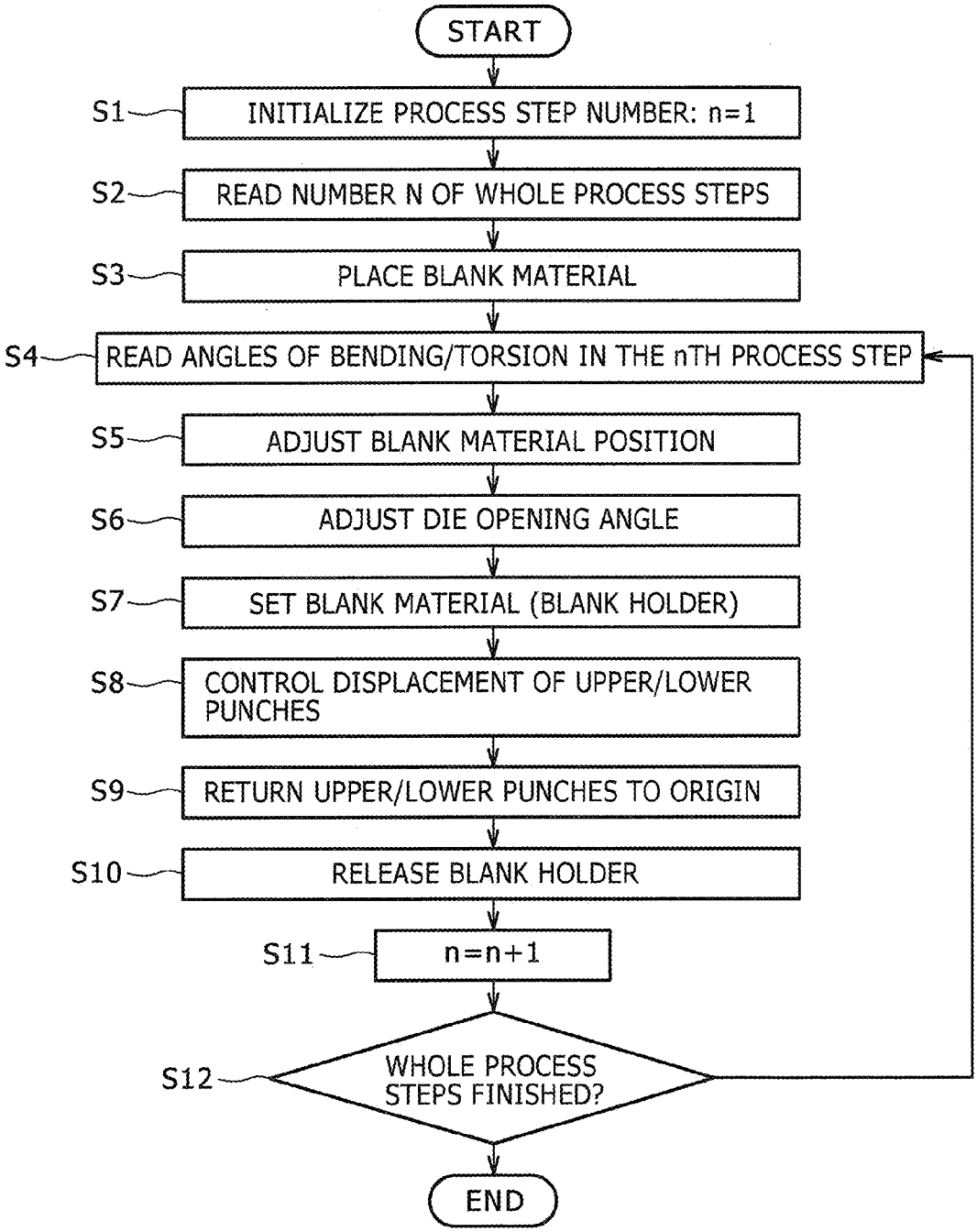
FIG. 8 is a flowchart showing the flow of the manufacturing method.

FIG. 8 is a flow chart showing the flow of the manufacturing method. In step S1, a step number n is initialized. Generally, the process starts from the first linear element, n=1 may be set. In step S2, the number N of the whole process steps is determined from the number of the linear elements of the blade surface design data so as to be input to the system. In step S3, the blank material is set to the initial position.

In step S4, the forming condition database is accessed to read data of the angle of torsion (including both positive and negative angles of torsional bending) and the bending stroke amount (including both positive and negative bending angle) corresponding to the process step number input in step S1. In step S5, the position of the blank material 10 is adjusted such that the blank material 10 coincides with edges of the punches 11*a* and 11*b*. In step S6, each opening angle defined by the punches 11*a* and 11*b*, and the dies 12*a* and 12*b* of the forming device is adapted to the opening angle defined by the linear elements. In step S7, the blank material 10 is restrained on the dies 12*a*, 12*b* with the blank holder.

In step S8, the state where the upper and the lower punches 11*a*, 11*b* are aligned with each surface of the blank material 10 is set as the default position in the process step. The displacement and tilt values are adjusted from the default state until the angles of torsion and the bending strokes reach the predetermined values. Specifically, the hydraulic cylinders 61*a* and 61*b* for controlling the punch execute the displacement control. Execution of the displacement control forms the blank material 10 to have the angles of bending and torsion which have been read in step S4.

In step S9, the upper and the lower punches 11*a* and 11*b* are returned to origin so as to be separated from the blank material. Each origin of the upper and the lower punches may be determined by the positions each as the point where the hydraulic cylinders 61*a* and 61*b* for controlling the punch are in the maximum compressed states. In step S10, the blank holder is released to bring the blank material into the free state so as to be movable to the subsequent process step.

In step S11, the process step number n is updated to that of the patch to be subsequently processed. Normally, the adjacent patch is expected to be processed next. Accordingly, the number is incremented by 1 to update the number n. In step S12, it is determined whether or not all the process steps have been performed. If all the process steps have been finished, the process ends. If all the process steps have not been performed yet, the process returns to step S4, and the subsequent steps are performed sequentially.

The blank material 10 is subjected to the incremental forming sequentially at the straight holder portions of the upper and the lower punches 11*a* and 11*b* to form substantially the straight boundary. Plural saddle shape patches are formed each defined between the boundaries.

Figure 9:
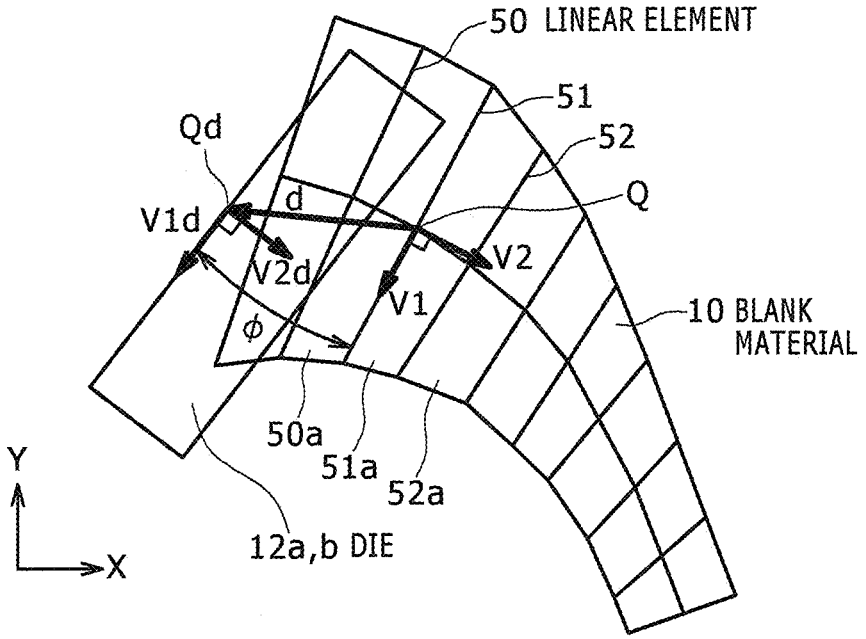
FIG. 9 is an explanatory figure showing the mechanism of calculating the displacement upon positioning of the blank material for the blade with respect to the forming portion.

FIG. 9 shows a mechanism with respect to calculation of the displacement upon positioning of the blank material 10 for the blade with the forming portion. The method for moving and rotating the blank material 10 for processing a saddle shape patch 50*a* between the linear elements 50 and 51 each as substantially straight boundary will be described. A center of the linear element 51 is set to Q, and a reference point Qd is defined on the die edge. The blank material 10 is moved and rotated such that a vector V1*d* having the Qd as the origin becomes parallel to the vector V1 having the Q as the origin defined on the blank material surface while coinciding the Q with the Qd. Reference numerals 51*a* and 52*a* denote saddle shape patches each processed between the linear elements subsequent to the linear element 51.

Figure 10:
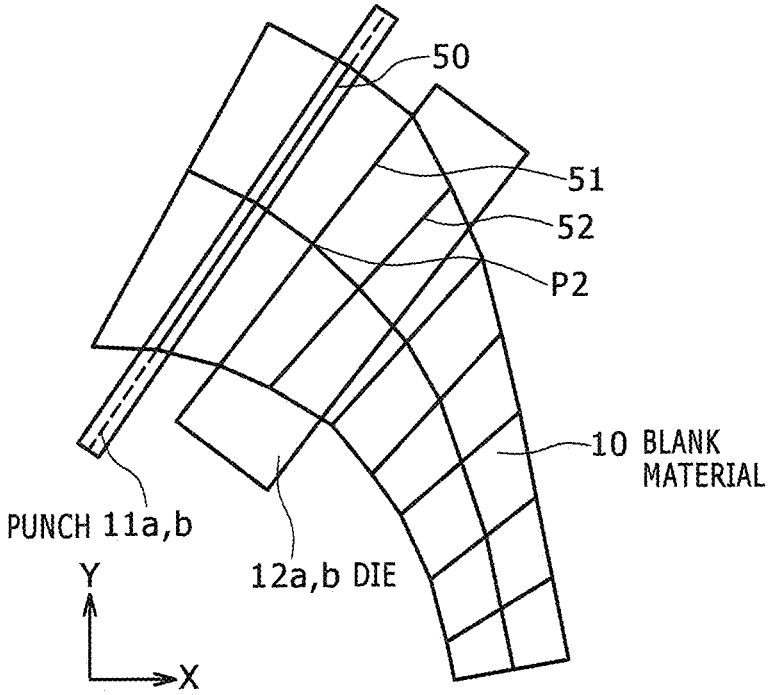
FIG. 10 is an explanatory figure showing the positional relationship with respect to the movement of the blank material for the blade and the state after rotation.

The blank material is moved and rotated to be positioned in the state as shown in FIG. 10. Specifically, the punches 11*a*, 11*b* are in parallel to the linear element 50, and edges of the dies 12*a*, 12*b* are also in parallel to the linear element 51.

Figure 11:
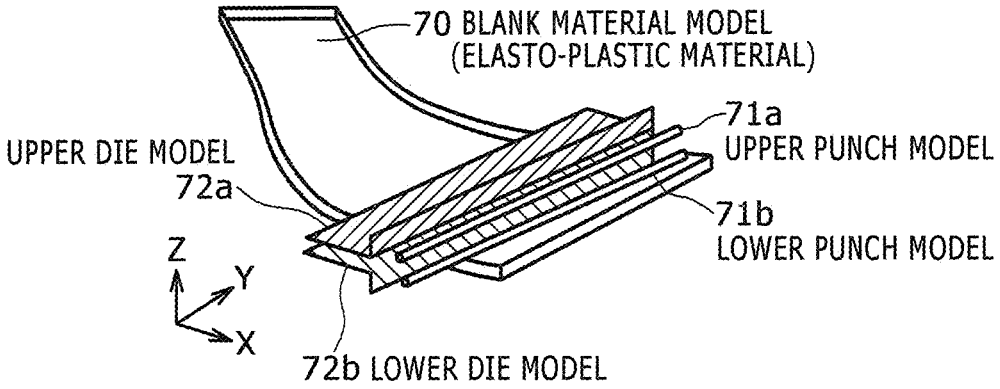
FIG. 11 is an explanatory figure of a finite element analysis model used for verification of the manufacturing method.

The analytical model derived from confirmation with respect to the manufacturing method according to the embodiment using the finite element analysis is shown in FIG. 11. The blank material is modeled (70) as an elasto-plastic material, and the upper and the lower punches (71*a*, 71*b*) and the upper and the lower dies are modeled (72*a*, 72*b*) as rigid bodies. The blank material is in contact with the upper and the lower dies, and further is in contact with the upper and the lower punches as well. The blank material is deformed by adding the predetermined angle of torsion and the bending stroke to the punch as the boundary condition.

Figure 12A:
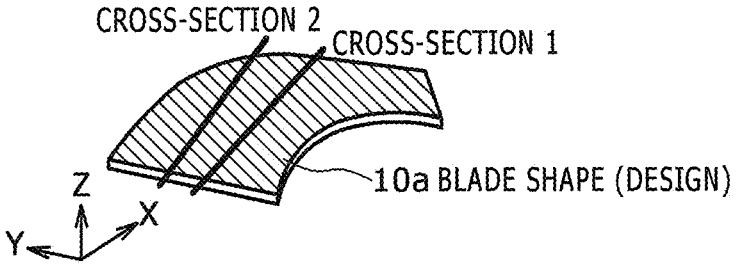
FIG. 12A and FIG. 12B are an explanatory figure showing results of the finite element analysis used for verification of the manufacturing method.
Figure 12B:
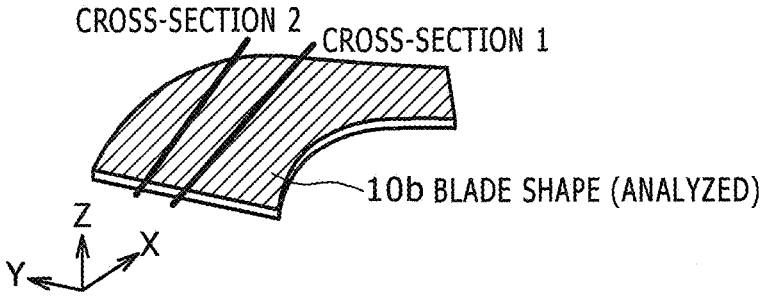
Figure 13:
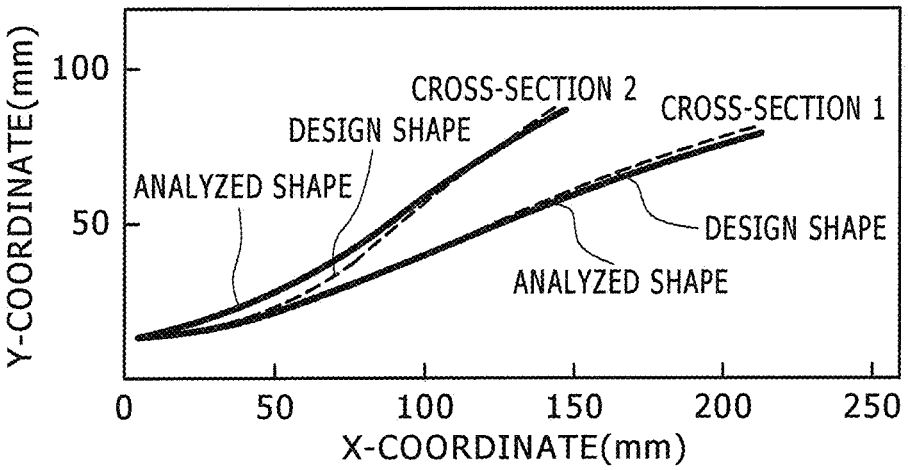
FIG. 13 is an explanatory figure showing the comparison between the analytical result and the design shape with respect to the cross-section.

FIGS. 12A and 12B show the design shape of the blade and the analytical result of the blade shape, respectively. The bending stroke and the angle of torsion derived from the design data with respect to the blade surface are applied in accordance with the aforementioned method to form the blank material into the shape substantially coincided with the design shape. FIG. 13 shows comparisons between the analytical results and the design shapes of cross-sections 1 and 2 shown in FIGS. 12A and 12B, respectively. As the analytical results show, the blade surface is formed of plural saddle shape patches, and has the bending angle on the blade surface as both positive and negative values. Although the analytical results partially show the deviation from the design shape by approximately 5 mm, the use of the manufacturing method according to the embodiment allows reproduction of the quantitative shape.

In the embodiment, each of the linear elements 50 and 51 is formed as the straight line, and the area between the saddle shape patches serves as substantially the straight boundary. If the linear element is curved, the area between the saddle shape patches serves as the curved boundary.

The blades thus formed designated as 5*a* and 5*b* shown in FIG. 2 are joined and fixed to the boss 3 through welding to form the impeller. The blade 5 may be joined and fixed only to the boss 3 as shown in FIG. 2, or may be joined and fixed to the portion between the boss 3 and the shroud 4 as shown in FIG. 1.

Second Embodiment

Figure 14:
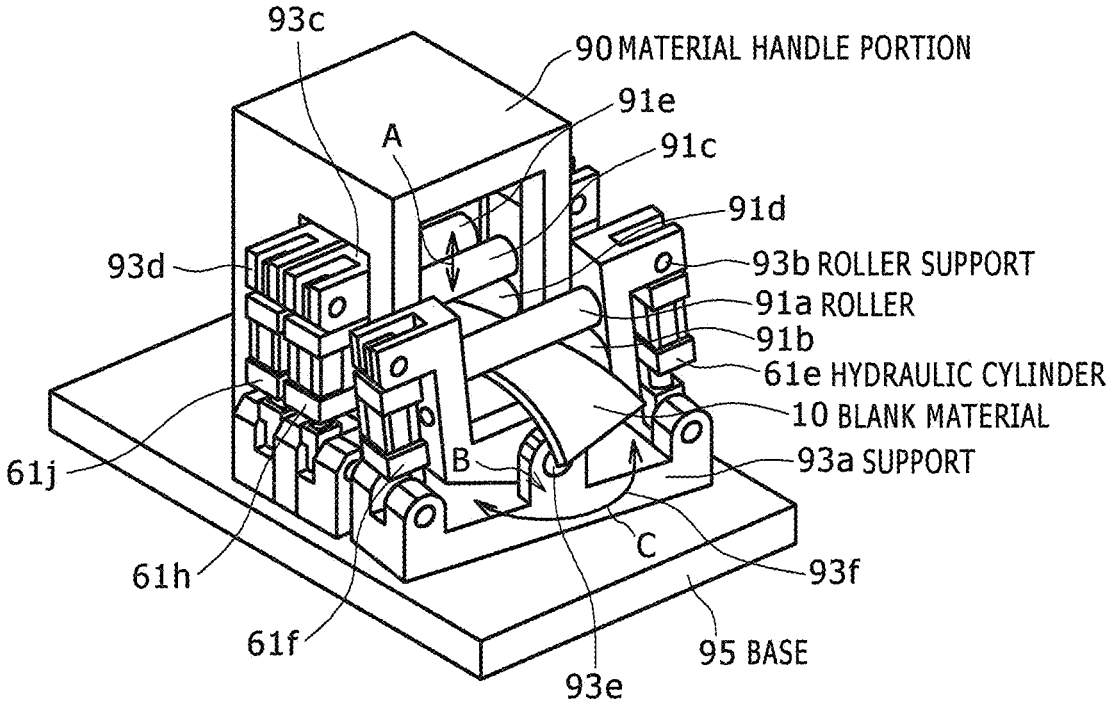
FIG. 14 schematically shows a manufacturing apparatus of roll forming type according to a second embodiment of the present invention.

FIG. 14 is a perspective figure of a manufacturing apparatus according to a second embodiment for forming the blank material 10 into the blade using a roller.

Two pairs of rollers 91*c* to 91*f* (91*f* is not shown) are disposed inside a material handle portion 90 as a frame. The roller 91*e* is driven to subject the blank material 10 to bending in the conveying process toward a support 93*a* while being restrained between the upper and the lower rollers. The aforementioned two pairs of rollers which constitute the material handle portion 90 are supported with roller supports 93*c* (second roller support) and 93*d* (third roller support), and are mounted on a frame 95 via hydraulic cylinders 61*h* and 61*i* each serving as an actuator and a slider mechanism. They are controlled by the hydraulic cylinders 61*h* and 61*i* to be driven to displace in the vertical direction as indicated by arrow A (up and down) together with the supports. Accordingly, the relative positional relationships between the two pairs of rollers 91*c* to 91*f* of the material handle portion 90 and the rollers 91*a* and 91*b* (first roller) of the support 93*a* may be changed.

The support 93*a* is rotatably mounted on the frame (base) 95 in the horizontal direction of the support 93*f* as indicated by arrow around the vertical axis of rotation (not shown as it is on the back surface of the support 93*a*). The horizontal rotation of the support may tilt the respective axes of rotation of the rollers 91*a* and 91*b* with respect to the axes of rotation of the rollers 91*c* to 91*f* of the material handle portion 90 along the horizontal plane. The roller support 93*b* (first roller support) provided with the rollers 91*a* and 91*b* is mounted on the support 93*a* via the horizontal axis of rotation 93*e* and the hydraulic cylinders 61*e* and 61*f* each serving as the actuator and the slider mechanism. The support 93*a* is mounted on the frame 95 via the vertical axis of rotation (93*f*). The hydraulic cylinders 61*e* and 61*f* controls the rollers 91*a* and 91*b* to be driven to tilt with respect to the surface of the blank material 10 (with respect to the axes of rotation of the rollers 91*c* to 91*f* of the material handle portion 90) conveyed from the material handle portion 90 along the vertical surface to subject the blank material to the bending process.

The height of the roller of the material handle portion 90, and each tilt angle of the supports 93*a* and 93*b* are controlled such that the rollers 91*a* and 91*b* (punches shown in FIG. 10) become parallel to the linear elements 50, 51, 52 and the like (see FIG. 10) of the blank material 10 conveyed from the material handle portion 90, which are passing through the rollers 91*a* and 91*b*. The blank material may be subjected to the bending process to have saddle shape patches formed thereon sequentially. The portion between the respective saddle shape patches becomes the curved boundary.

In the embodiment, the respective boundaries between the saddle shape patches are defined as straight linear elements on the upper surface of the blank material for the blade. The first, second and third roller supports each provided with two upper and lower rollers are used to bring the three consecutive linear elements from the first to the third linear elements into parallel to the axes of the rollers of the roller supports. In the aforementioned state, when an arbitrary roller of the roller support is driven to convey the blank material, the relative positional relationship with respect to the roller supports is adjusted such that the positional relationship between the line passing through the first roller and the linear element prior to the passage through the first roller becomes the positional relationship of the linear element of the design shape while constantly maintaining in parallel to the linear element passing through the roller. The saddle shapes are sequentially formed to allow the blank material to be formed into the desired blade shape.

In the embodiment, the support 93*b* is mounted on the frame 95 via the axes of rotation which are mutually perpendicular in the horizontal and vertical directions. Alternatively, the supports 93*c* and 93*d* of the roller of the material handle portion 90 may be mounted on the frame 95 via the axes of rotation which are mutually perpendicular in the horizontal and vertical directions such that the support 93*b* is directly mounted on the frame 95. Any structure may be employed so long as the relative positional relationship between the rollers of the support 93*c* and the support 93*b* is changeable for subjecting the blank material to the bending process.

In another modified example, at least one of the roller supports is mounted on the frame 95 with the vertical axis of rotation and the horizontal axis of rotation via the support, and the rest of the roller supports are directly mounted on the frame 95. Alternatively, the roller support mounted on the actuator/slider mechanism is mounted on the frame 95, and the rest of the roller supports are mounted on the frame 95 via the vertical axis of rotation and the horizontal axis of rotation via the support. In another example, the vertical axis of rotation and the horizontal axis of rotation are substantially perpendicular to each other, and an actuator for controlling each rotating angle of the vertical and the horizontal axes of rotation is provided.

In the embodiment, the blank material is expected to slip on its surface. However, the slippage may be suppressed by the use of the guide roller on the side surface of the blank material.

Third Embodiment

Figure 15:
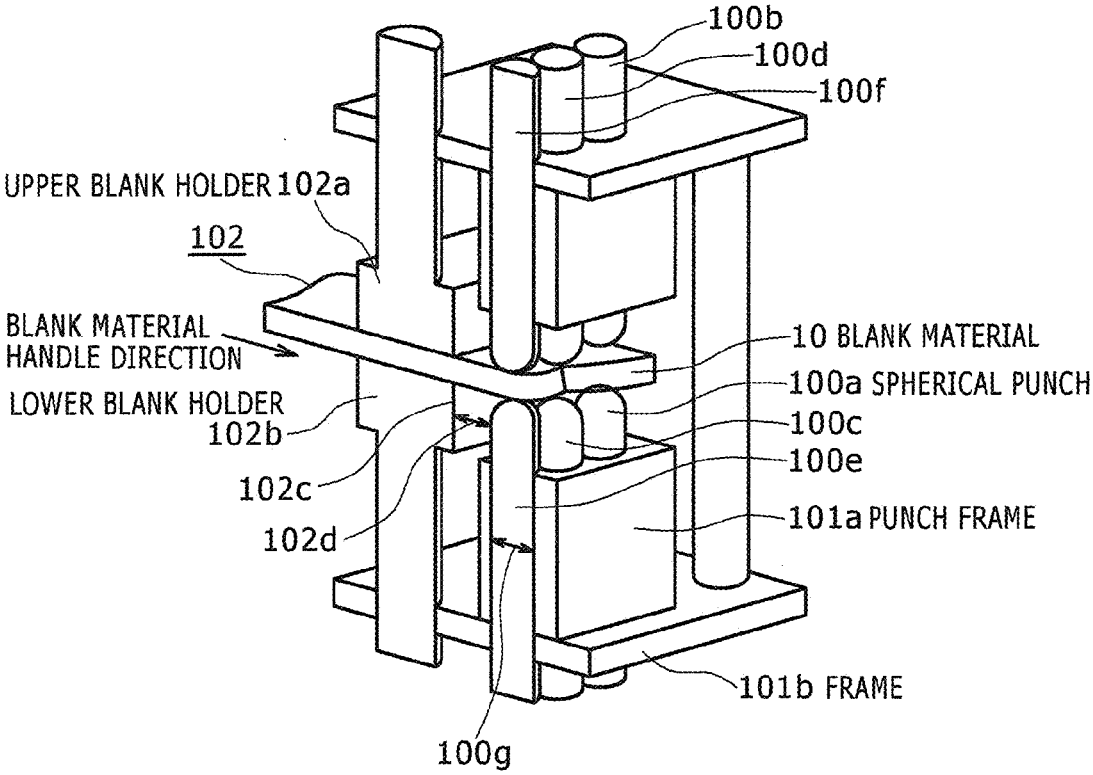
FIG. 15 schematically shows a manufacturing apparatus of multipoint press type according to a third embodiment of the present invention.

FIG. 15 shows an embodiment of the apparatus for manufacturing the impeller, which forms saddle shape patches sequentially on a part of the blade using a multipoint press machine. Each of punch matrices (100*a* to 100*e*) is formed by arranging matrices each having spherical punches 100 arranged to have substantially the same width as that of at least the blank material 10 (corresponding to 10 punches) disposed above and below the blank material 10 in the width direction. In the embodiment, the blank material 10 is processed between the upper and the lower punch matrices.

A press mechanism (not shown) is provided with at least a press ram (not shown) which is allowed to displace and pressurize. In the state where the spherical punch matrices are slidably supported with a punch frame 101*a* and a frame 101*b*, they are movably disposed opposite with each other. The punch matrix is formed of approximately 10 lower punch matrices arranged in the width direction of the blank material 10 for the blade, and the upper punch matrices having substantially the same number of punch matrices as the lower punch matrices. A die 102 is formed of upper and lower blank holders 102*a* and 102*b* for restraining a portion of the blank material 10 under the pressure of the press ram. The die 102 is arranged such that an edge 102*c* of a die shoulder is apart from the punch matrix by a distance 102*d* corresponding to at least a punch diameter 100*g*.

Upon formation, the leading end of the punch 100 is brought into contact with the portion of the blank material 10 to be formed such that the displacement of each punch is controlled by the press ram (first process step). The blank holders 102*a* and 102*b* are provided for the portion of the blank material 10 not to be processed so as to restrain the blank material 10 during the process. Each final position of the respective punches is defined as the position in contact with the blank material surface when the blank material to be formed into the target shape is placed. Based on the thus obtained displacement command, the punch is controlled to displace. As a result, the tiny saddle shape patch is formed at a portion in contact with the punch under pressure (second process step).

The respective punches are moved to the initial positions to release the restrained blank material. Then the blank material 10 is conveyed (third process step) in the arrow direction to control the displacement of the punch again such that the tiny saddle shape patch is newly formed adjacent to the patch. The aforementioned operations are performed sequentially over the whole surface of the blade to form the tiny saddle shape patches at a small pitch, thus forming the predetermined blade shape. In the embodiment, the boundary of the saddle shape patch is curved.

Upon formation of the saddle shape patch on the blank material for the metal plate of the blade of the impeller which is rotatably mounted on the turbo fluid machine through the incremental forming, each boundary between the saddle shape patches is defined as the curved line on the blank material for the blade. The multipoint press machine having plural punch matrices arranged in the width direction of the blank material for the blade opposite in the vertical direction is used such that the plural spherical punches are movable in the height direction. The blank material is held in contact with the opposite head portions of the upper and the lower punch matrices in the first process step. In the second process step, the height of the punch matrix is displaced to form the saddle shape patch having the curved boundary on the portion of the blank material. In the third process step, the interval between the opposite heads of the punch matrix is increased to release the blank material. Thereafter, the first to the third process steps are repeatedly performed to form the saddle shape patches sequentially over the whole blank material so as to form the desired blade shape.

Fourth Embodiment

Figure 16:
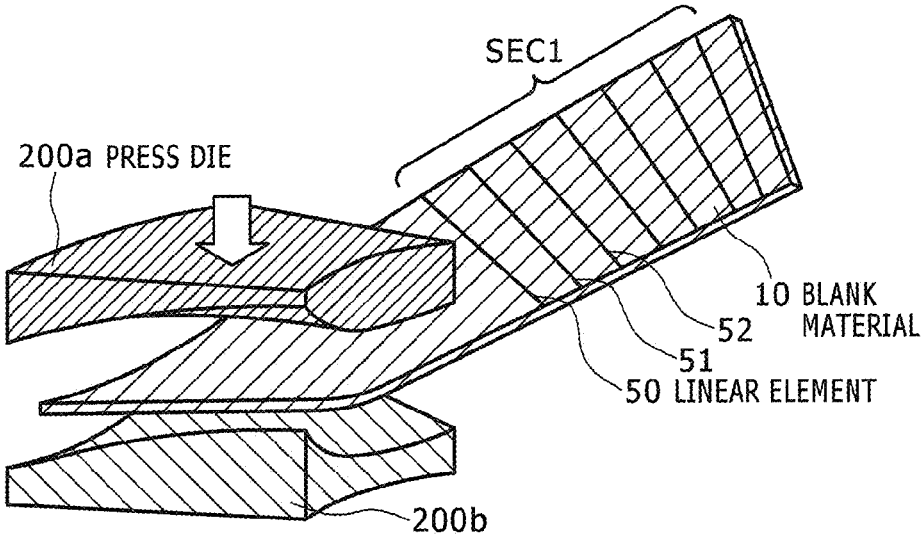
FIG. 16 schematically shows a manufacturing method according to a fourth embodiment of the present invention.

FIG. 16 shows an embodiment in which press dies 200*a* and 200*b* each as a partial three-dimensional forming die is used for an incremental forming. The rest of the portion SECT is subjected to the manufacturing method according to the aforementioned embodiment. In the embodiment, the leading end of the blade which is required to have the high profile accuracy for enhancing the operation efficiency is subjected to the press forming using the partial dies 200*a* and 200*b*, thus realizing high accuracy. The rest of the portion is subjected to the manufacturing method according to the aforementioned embodiment to reduce the die cost. This makes it possible to provide the less expensive turbo fluid machine. The embodiment is especially effective for reducing the die cost when the length of blade is long in the large pump.

Fifth Embodiment

Figure 17:
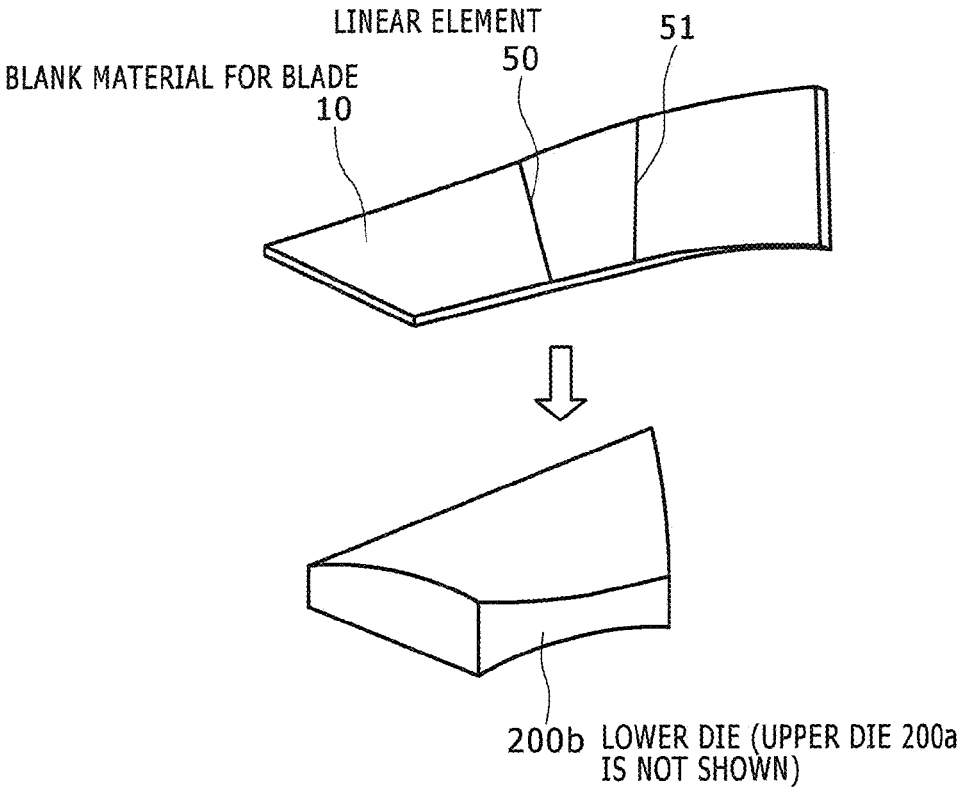
FIG. 17 schematically shows a blank material and a die employed for a manufacturing method according to a fifth embodiment of the present invention.
Figure 18:
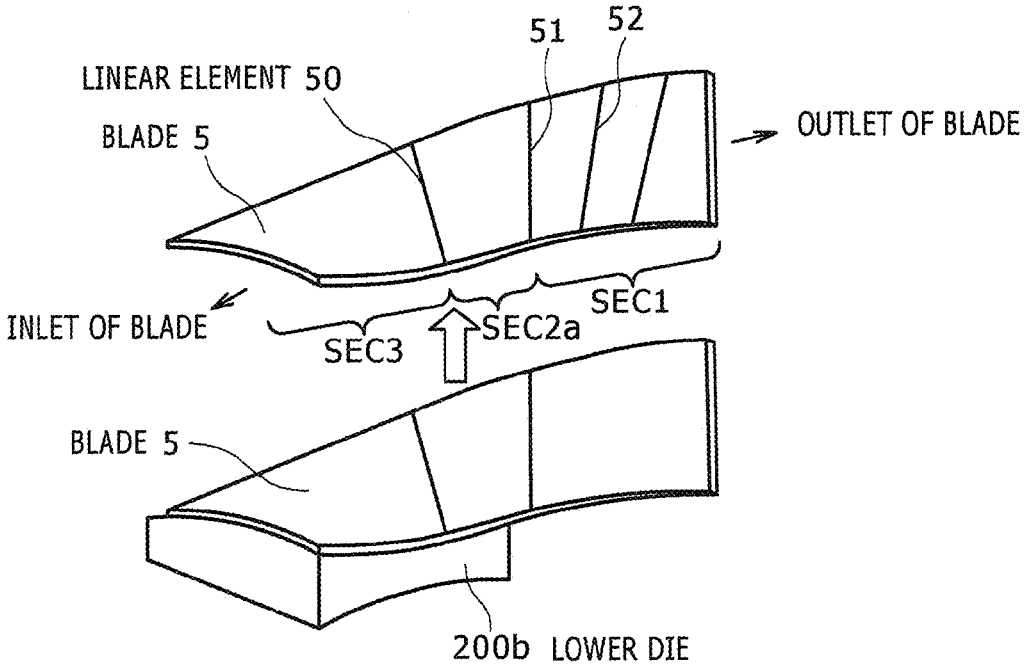
FIG. 18 schematically shows the manufacturing method according to the fifth embodiment of the present invention.
Figure 19:
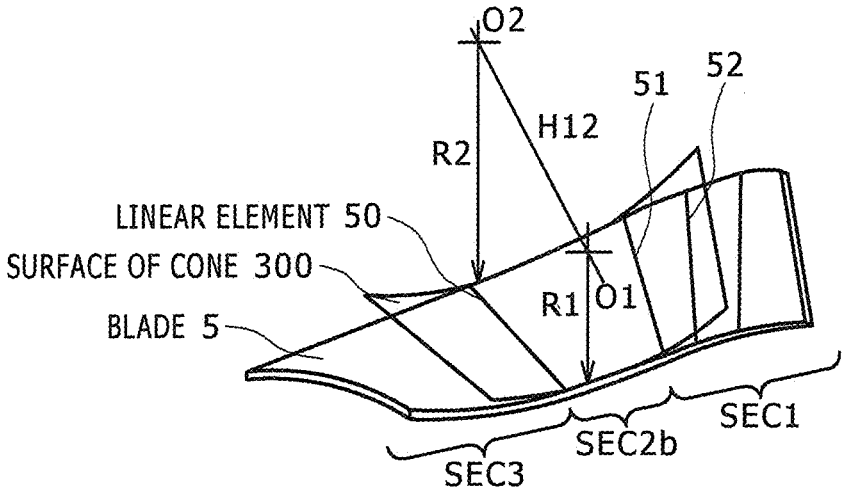
FIG. 19 shows the blade as another form according to the fifth embodiment of the present invention.

FIGS. 17 and 18 show the method for manufacturing the blade which constitutes the impeller mounted on the turbo fluid machine according to another embodiment. In the embodiment, the portion around the inlet of the blade is formed using the partial die. The blade to be manufactured by the manufacturing method according to the embodiment has only the inlet and outlet portions formed of the saddle shape patches (SECS, SECT). The part of the saddle shape patch (SECT) is press formed with the partial die. The portion of the blade corresponding to the boundary of the die is formed to become substantially a flat surface, or substantially a cone shape including linear elements (50, 51) as the boundaries. FIG. 17 shows that the blade having the transient region (between 51 and 52 shown in FIG. 18) formed as substantially flat surface. FIG. 19 shows the blade having the transient region formed as substantially conical shape (SEC 2*b*). The embodiment with respect to the transient region formed as substantially the flat surface will be described in detail.

The die having the same boundary as that of the patch which is the closest to the outlet among the saddle shape patches for forming the inlet shape on the blade surface may be employed as the partial die for forming the blade. This may prevent the transfer of the saddle shape torsional deformation to the blank material at the outlet of the blade when forming the saddle shape patch at the leading end of the blank material for forming the blade to provide the three-dimensionally torsional shape.

In the embodiment, the shape of the blade surface of the transient region SEC 2 between the area to be press formed by the die and the saddle shape patch at the outlet is formed to substantially the flat surface or substantially conical shape so as to enhance the profile accuracy of the whole blade with easy forming. The leading end of the blade which is required to have the high profile accuracy is subjected to the press forming using the partial dies 200*a* and 200*b* for enhancing the operation efficiency, thus providing high accuracy. The other portion is subjected to the manufacturing method as described in the previous embodiment, thus reducing the die cost and providing the less expensive turbo fluid machine. The present embodiment is effective for reducing the die cost especially when the length of blade is long in the large pump.

The region to be formed into the saddle shape patch may be determined at the inlet of the blade, and have a length approximately 25% of the outer size of the impeller so as to sufficiently maintain the desired pump performance while reducing the size of the saddle shape die and suppressing the die cost. Among boundaries of the die, the boundary at the outlet side of the blade is offset to be closer to the outlet than the boundary between the saddle shape patch on the blade surface and the transient region to further suppress the influence of the torsional deformation of the blade inlet transferred to the outlet side. The degree of the torsion of the saddle shape patch may be adjusted such that the blade surfaces are smoothly connected around the boundary between the transient region and the saddle shape patch at both ends.

Sixth Embodiment

Figure 20:
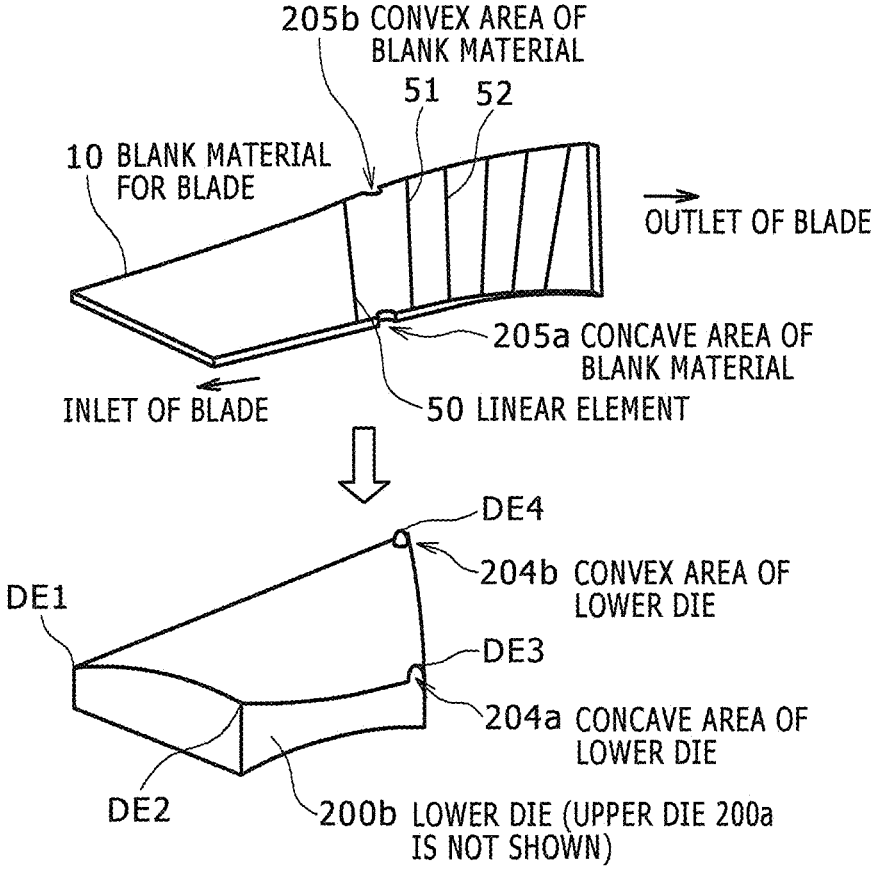
FIG. 20 schematically shows a blank material and a die employed for a manufacturing method according to a sixth embodiment of the present invention.

FIG. 20 shows a manufacturing method with respect to the blade according to another embodiment among those for forming the impeller to be mounted on the turbo fluid machine. The figure especially represents the state prior to the press forming. FIG. 20 shows the blade having a concave area formed in the saddle shape patch on the blade surface for forming the saddle shape at the inlet of the impeller. Specifically, concave areas 205*a* and 205*b* are preliminarily formed in the portions to be substantially flat surface between the linear elements 50 and 51 of the blank material 10 for the blade. Meanwhile, convex areas 204*a* and 204*b* are preliminarily formed in the lower die 200*b* for the saddle shape die at the corresponding positions.

Figure 21:
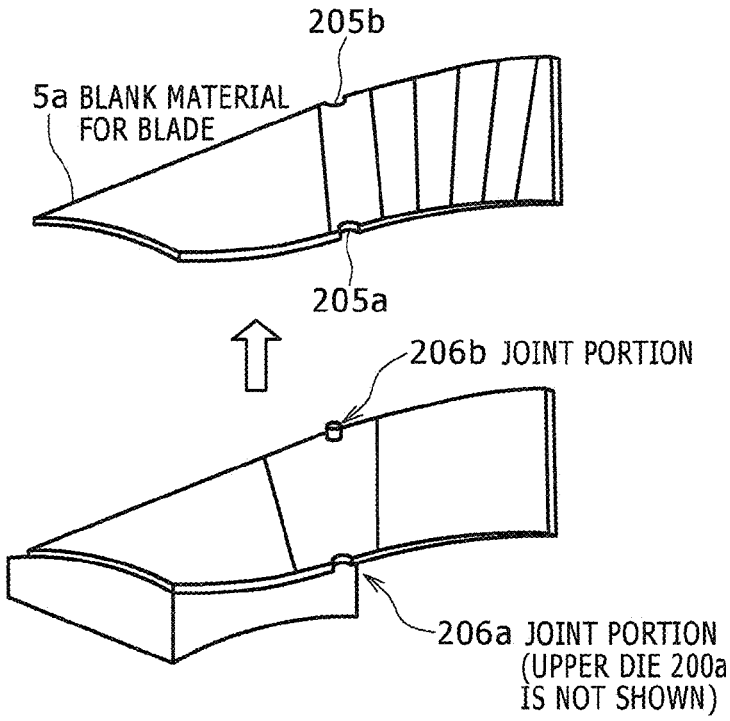
FIG. 21 schematically shows the manufacturing method according to the sixth embodiment of the present invention.

FIG. 21 shows the state where the press forming is finished. Upon formation of the saddle shape patch formed on a part of the blade surface using the press die, the press forming is performed while joining the concave areas of the blank material 10 with the convex areas at the predetermined positions of the press die (represented by joint portions 206*a* and 206*b*). In the embodiment, the leading end of the blade required to have the high profile accuracy for enhancing the operation efficiency is press formed using the partial dies 200*a* and 200*b* by joining the blade and the part of the die on the blade surface. This makes it possible to prevent misalignment of the blank material from the predetermined position during the press forming, thus forming the blade shape with high accuracy in the stable state. The other portion is subjected to the manufacturing method as described in the previous embodiment to reduce the die cost, thus providing the less expensive turbo fluid machine.

The concave area is formed after the sequential forming of the incremental patches, and the formation is then performed while joining the concave area of the blank material with the convex area of the saddle shape die. In the aforementioned forming order, the substantially flat surface portion where the blank material is unlikely to be misaligned is formed first, and the saddle shape portion is formed subsequently so as to realize the forming of the saddle shape portion with high accuracy.

Each shape of the concave and convex areas is set such that the joint contact portion is formed to have a hemispherical shape to prevent misalignment caused by the slippage of the blank material without excessively suppressing the deformation of the blank material during the formation.

The concave areas may be positioned around two corner points at the outlet side of the blade among four corner points of the blade after the forming as shown in FIG. 20. However, the convex area may be formed at one corner point selected from two corner points at the outlet side of the blade. In the aforementioned case, the formation is performed using the die provided with the guide to provide the similar effects. The similar effects may be obtained in the case where the convex area is formed on the blade, and the concave area is formed on the die.

Figure 22:
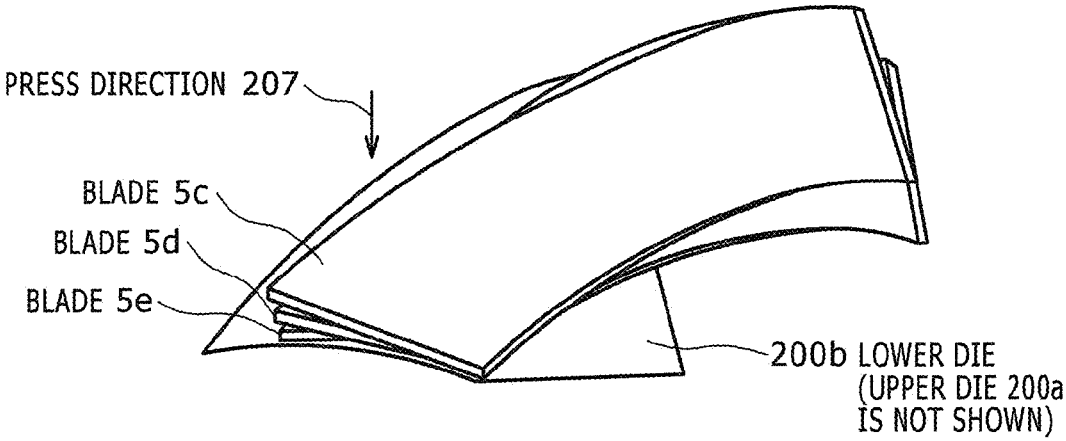
FIG. 22 shows a result of the finite element analysis as a comparative case with respect to the manufacturing method according to the sixth embodiment of the present invention.
Figure 23:
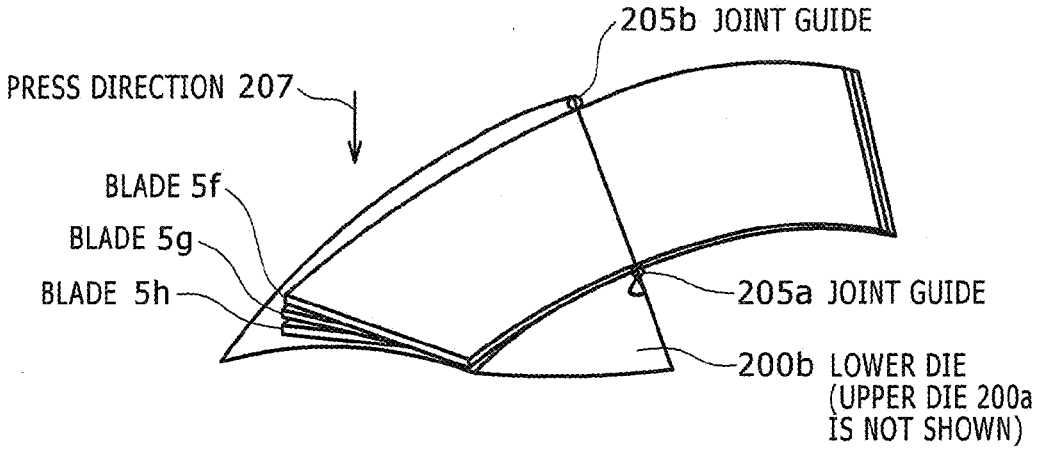
FIG. 23 shows a result of the finite element analysis with respect to the manufacturing method according to the sixth embodiment of the present invention.

FIGS. 22 and 23 show results of the forming simulation performed for verifying the effect derived from the joint of the blade with the die by means of concave and convex areas thereof in the aforementioned manufacturing method. Specifically, the figures represent an overlapped state of each deformation of the blank material in three stages from start to the end of the press forming process step. The upper die 200*a* is not shown for the purpose of focusing the deformation of the blank material inside the die. FIG. 22 shows the analytical results with respect to formation of the blank material using no joint under no restraining condition. FIG. 23 shows the forming simulation results with respect to the restrained state established by guides 205*a* and 205*b* formed by joining the concave area or the convex area in the center of the blade with the die.

If the joint guide is not used, the blank material slips due to contact reaction force caused by the contact with the die. It is observed that the blades 5*c*, 5*d*, and 5*e* are rotated while displacing. Meanwhile, if the joint guide is used, the blank material does not slip, and the blades 5*f*, 5*g*, and 5*h* may be formed into the three-dimensional torsional shapes at the predetermined positions of the die.

Figure 24:
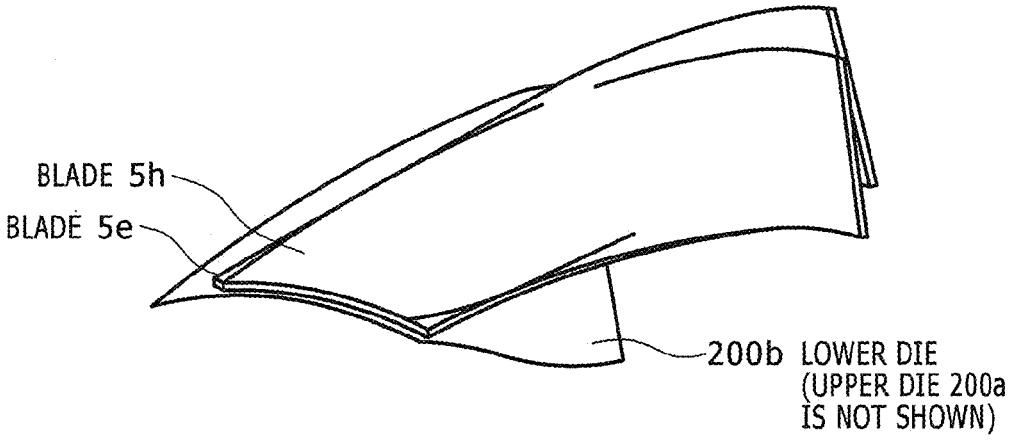
FIG. 24 shows a result of the finite element analysis of the manufacturing method according to the sixth embodiment of the present invention.

FIG. 24 shows the comparative case with respect to the misalignment of the blank material at the end of the press forming between the case where the joint guide is used and the case where the joint guide is not used. If the blade has the large degree of torsion, the blank material is likely to move on the die surface during the formation. The displacement of the blank material for forming the blade from the predetermined position may deteriorate the profile accuracy.

Figure 25:
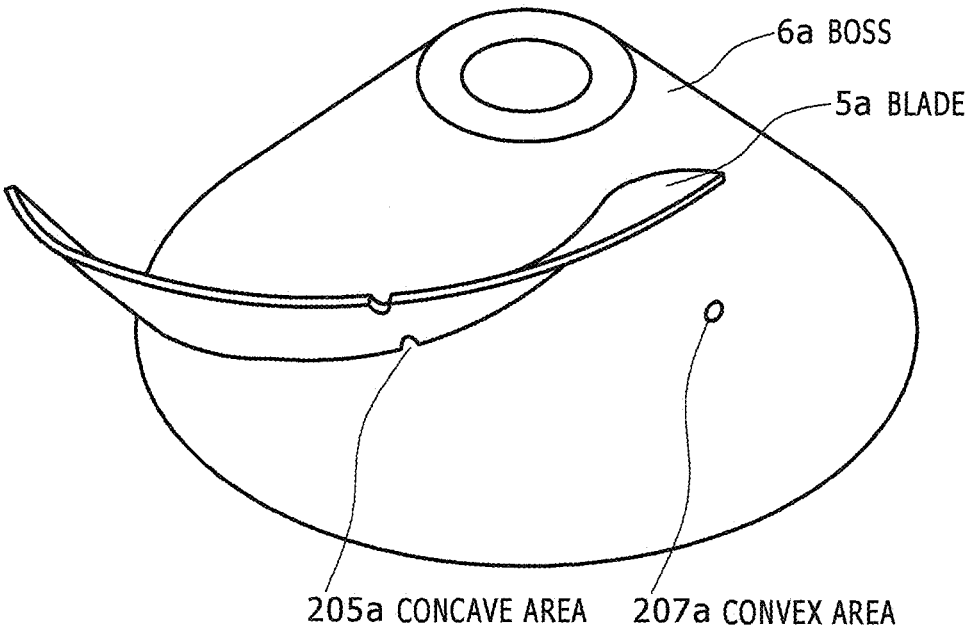
FIG. 25 shows an impeller using the blade manufactured with the method according to the sixth embodiment of the present invention.

FIG. 25 shows the impeller formed by joining blades 5*a* formed through the aforementioned manufacturing method with a boss (hub) 6 with substantially cone shape. Upon attachment of the blade, the concave area 205*a* formed in the blade 5*a* is joined with the convex area 207*a* formed at the portion of the boss to which the blade is attached. The impeller, thus, may be assembled quickly with high accuracy. The joint structure of the concave and the convex areas is effective for improving the assembly accuracy in addition to the improvement of the accuracy for forming the blade as described above.

What is claimed is:

1. An apparatus for manufacturing a blade of an impeller rotatably mounted on a turbo fluid machine by performing a plastic deformation of a metal plate blank material, the apparatus comprising:

at least a first ram and a second ram arranged for independently displacing and pressurizing;

a die operatively connected to the first ram and arranged for restraining the blank material under pressure applied by the first ram;

a punch that is operatively connected to the second ram and deforms the blank material by a displacement of the second ram while keeping a portion of the blank material protruding from the die clamped;

a first rotational mechanism that is operatively connected to the second ram;

a punch support that is operatively connected to the first rotational mechanism and tilts the punch via the first rotational mechanism in a first direction;

a second rotational mechanism that is operatively connected to the die and tilts the die and the punch relatively in a second direction that is perpendicular to the first direction; and an actuator that is operatively connected to the first and second rotational mechanisms for controlling angles of rotation of the first and second rotational mechanisms, and wherein axes of rotation of the first and second rotational mechanisms are disposed to be perpendicular to each other to apply a predetermined deformation to the blank material in accordance with the displacement and the tilt of the die and the punch under controls of the first and second rams, and the actuator.

* * * * *